US008381745B2

(12) United States Patent
Classen et al.

(10) Patent No.: US 8,381,745 B2
(45) Date of Patent: Feb. 26, 2013

(54) WATER-CONDUCTING APPLIANCE HAVING A CLEANING AGENT FEEDING DEVICE

(75) Inventors: Egbert Classen, Wertingen (DE); Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 638 days.

(21) Appl. No.: 12/515,867

(22) PCT Filed: Mar. 31, 2008

(86) PCT No.: PCT/EP2008/053824

§ 371 (c)(1),
(2), (4) Date: Oct. 22, 2009

(87) PCT Pub. No.: WO2008/125473

PCT Pub. Date: Oct. 23, 2008

(65) Prior Publication Data

US 2010/0083990 A1 Apr. 8, 2010

(30) Foreign Application Priority Data

Apr. 11, 2007 (DE) ..... 10 2007 017 117

(51) Int. Cl.
*B08B 3/00* (2006.01)

(52) U.S. Cl. ..... 134/99.2; 134/56 D; 134/57 D; 134/58 D; 134/94.1; 134/95.1; 134/99.1

(58) Field of Classification Search ..... 134/56 D, 134/57 D, 58 D, 94.1, 95.1, 99.1, 99.2
See application file for complete search history.

(56) References Cited

U.S. PATENT DOCUMENTS

| | | | | |
|---|---|---|---|---|
| 3,827,600 | A * | 8/1974 | Janke | 222/651 |
| 5,839,454 | A | 11/1998 | Matz | |
| 7,789,967 | B2 | 9/2010 | Classen et al. | |
| 2006/0059958 | A1 * | 3/2006 | Byrne et al. | 68/17 R |
| 2006/0060229 | A1 * | 3/2006 | Gonska et al. | 134/56 D |
| 2006/0254626 | A1 * | 11/2006 | Botts et al. | 134/110 |
| 2009/0000644 | A1 | 1/2009 | Druecker et al. | |

FOREIGN PATENT DOCUMENTS

| | | | |
|---|---|---|---|
| DE | 3513640 | A1 | 10/1986 |
| DE | 3833961 | A1 * | 4/1990 |
| DE | 3901218 | A1 | 7/1990 |
| DE | 3904423 | A1 | 8/1990 |
| DE | 10339130 | A1 | 3/2004 |
| DE | 102004051065 | A1 | 4/2006 |

(Continued)

OTHER PUBLICATIONS

Report of Examination EP 08 718 362.0, Jul. 31, 2012.

*Primary Examiner* — Michael Barr
*Assistant Examiner* — Charles W Kling
(74) *Attorney, Agent, or Firm* — James E. Howard; Andre Pallapies

(57) ABSTRACT

A water-conducting domestic appliance including a line system, a detergent feed facility that supplies at least one detergent into the line system, wherein the detergent feed facility includes at least one reservoir configured to be filled with detergent, and a refill fitting having a connection to the at least one reservoir, the refill fitting being arranged on a door of the water-conducting domestic appliance.

23 Claims, 1 Drawing Sheet

FOREIGN PATENT DOCUMENTS

| | | | |
|---|---|---|---|
| DE | 102006043975 | A1 * | 3/2008 |
| EP | 0379665 | A1 | 8/1990 |
| GB | 2279069 | A | 12/1994 |
| WO | 2006/073885 | A2 | 7/2006 |

* cited by examiner

WATER-CONDUCTING APPLIANCE HAVING A CLEANING AGENT FEEDING DEVICE

BACKGROUND OF THE INVENTION

This application claims the benefit of PCT application no. PCT/2EP2008/053824 with an International Filing Date of Mar. 31, 2008, published as WO 2008/125473, which further claims priority to German Patent Application DE 10 2007 017117 filed Apr. 11, 2007, the entire contents of both being herein incorporated by reference. The invention relates to a water-conducting domestic appliance as set forth herein.

Domestic dishwashers have a detergent and rinsing aid dispenser arranged on the inner door of the dishwasher which dispenses its entire contents at a specific point in time. This requires that such a domestic dishwasher must be provided with detergent and/or rinsing aid before each new washing cycle. As an alternative to using separate detergents and rinsing aids, combination products in tablet form are known which are introduced into the washing area at the start of each new washing cycle. In such cases these combination means are designed so that they release their active components, such as detergents, rinsing aids, glass protectors etc. at intervals. With washing programs for domestic dishwashers which have a significantly shortened duration, for example 30 minutes and are referred to as fast programs, as a result of the shortened program execution time not all components of such a compressed detergent are able to dissolve and they do not thus have their optimum effect, so that for example glasses exhibit irritating flecks of water at the end of such a washing process.

A water-conducting domestic appliance, especially a household dishwasher, is known from DE102006043975, the line system of which is connected to a detergent feed device which allows at least one detergent to be fed into the line system. The detergent feed device features a refillable reservoir which a plurality of chambers for holding different detergent components. The chambers can be used for hold the following substances: Alkali agents, e.g. liquor, complexing and dispersing substances; e.g. polymers; enzymes such as amylase, protease or lipase; bleaching agents, e.g. hydrogen peroxide; bleach activator, and surfactants, such as non-ionic surfactants for example. A liquid with a biocide action can also be stored in the chamber, such as biocides against bacteria for example (bactericides), against fungi (fungicides), against germs (microbicides), against viruses (virocides) and also against algae (algicides) which, when added, suppress unpleasant smells developing, e.g. caused by the formation of biofilms during longer periods of inactivity for example. For filling the reservoir a refill fitting leading into the washing area of the water-conducting domestic appliance is provided, which, with a corresponding refill element allows all chambers of the reservoir to be filled simultaneously. However the refill fitting arranged in the washing area is difficult to reach.

SUMMARY OF THE INVENTION

The object of the invention is thus to provide a remedy for this problem.

The object of the invention is achieved by the refill fitting connected to the reservoir being arranged on the door. This allows the refilling process to be simplified by using a refill element, since it is now no longer necessary, before undertaking a refilling operation, to remove a crockery basket located in the washing area as well as the spray arm or to move the arm into such as position that the refill fitting is readily accessible, but instead the refill element can easily be placed on a refill fitting on the door.

Preferably there is provision in such cases for the refill fitting to be arranged as to be only accessible to an operator when the door is open. The result achieved is that the refill fitting is not visible to an operator when the door is closed and thus does not adversely affect the outward appearance of the water-conducting domestic appliance. There is also no need to hide the refill fitting by hinging it closed or by other mechanisms when it is not in use.

In this case there is provision in a first embodiment of the invention for the refill fitting to be arranged on the inner door, meaning that it is arranged for example in the area in which known detergent and rinsing aid dispensing devices are arranged.

In a second, alternate embodiment there is provision for the refill fitting to be arranged on the upper edge of the door, meaning in an area in which for example fully-integrated domestic appliances have their control elements for control, such as for program selection for example.

In both exemplary embodiments the refill fitting is arranged such that a refill element placed onto it empties itself automatically by the force of gravity and the detergent flows through lines automatically into the chambers of the reservoir of the detergent feed device.

Preferably a circulation pump is provided, with a connection to the detergent feed facility, so that the amount of detergent can be dosed with the circulation pump. Valves can be provided for this purpose, which are closed when the detergent is being conveyed or alternatively a tap is closed. This allows the pressure and the mass flow and thereby the amount of detergent to be determined via the speed of the circulation pump, without additional pumps being necessary for dosing the detergent.

Further a conductivity sensor is preferably provided, which allows the predetermined amount of detergent to be detected by measurement of the conductivity in order to increase the dosing accuracy in this way.

In a preferred embodiment there is provision for the inventive water-conducting domestic appliance to be embodied so that a load detection device is provided for the circulation pump. For example the load detection device can detect fluctuations in the power consumption of the circulation pump. The load detection device of the circulation pump allows detection based on a change in load during operation of the circulation pump of whether a chamber is still filled with detergents or not. In this case a control of a domestic dishwasher can be embodied such that it generates an optical and/or acoustic signal when the chamber is empty, which alerts the operator to the empty chamber.

Preferably there is provision for the detergent feed facility to be arranged in the floor pan of a domestic dishwasher. The arrangement of the detergent feed facility in the floor pan of a domestic dishwasher below a washing area offers the advantage of a compact design, since as well as the detergent feed facility, the circulation pump is integrated into the floor pan and from there the detergent-laden washing liquor is supplied to the spray arm.

Preferably the detergent feed facility has pumping means for pumping in at least one detergent. This allows liquid detergents as well as rinsing aids to be conveyed directly from the chambers into the washing area.

In a preferred embodiment there is provision for the detergent feed facility to have at least one dosing chamber in which the detergents are mixed with the rinsing water. In such cases the dosing chambers allow an improvement of the dosing and by mixing the washing liquor an improved cleaning power.

There is also preferably provision for the detergent feed facility to be embodied for automatic gravitational emptying.

Finally there is provision in a preferred embodiment for the refill fitting to be embodied to correspond to a connection of the refill element.

BRIEF DESCRIPTION OF THE DRAWINGS

The invention is explained below with reference to a drawing. The figures are as follows.

DETAILED DESCRIPTION OF THE EXEMPLARY EMBODIMENTS OF THE PRESENT INVENTION

Figure 1:
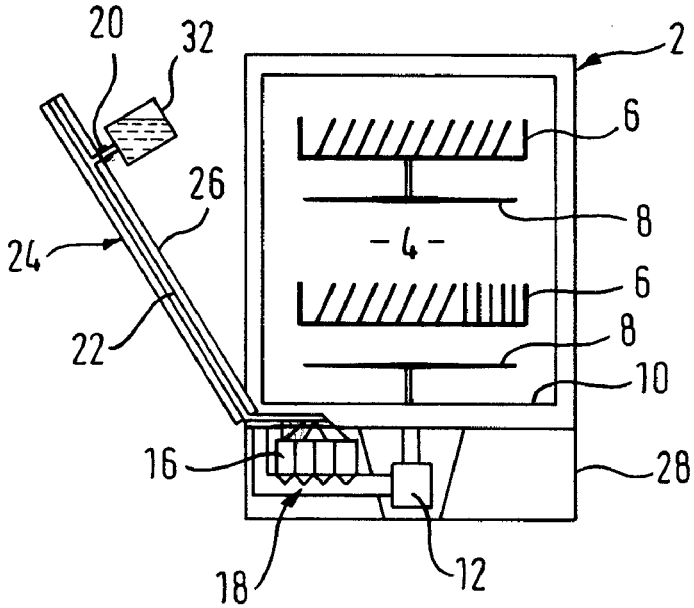
FIG. 1 a schematic diagram of a first exemplary embodiment of the invention, and FIG. 2 a schematic diagram of a second exemplary embodiment of the invention.
Figure 2:
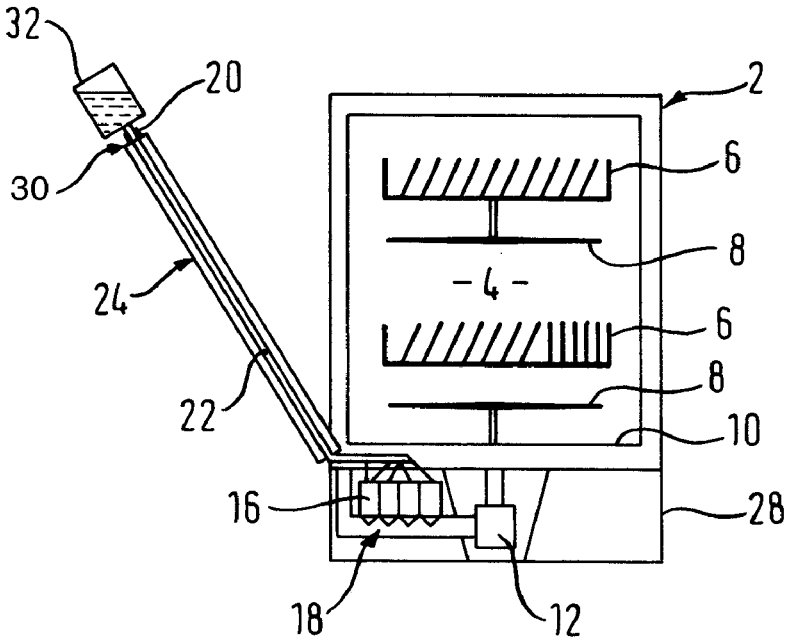

Reference is made to FIGS. 1 and 2.

Shown as an example of a water-conducting domestic appliance is a domestic dishwasher 2, which has a washing area 4 in which two crockery baskets 6 are arranged one above the other. In order to apply washing liquor to the dishes placed in the crockery baskets 6, a rotatable spray arm 8 is arranged below each the two crockery baskets 6, which are supplied with washing liquid via a line system (not shown) of the domestic dishwasher 2.

Below the washing area 4 the domestic dishwasher 2 has a floor pan 10, in which a detergent feed facility 18 is arranged alongside the circulation pump 12, which allows detergents, especially liquid or also gel-form detergents, to be supplied to the washing liquor circulated during operation by the circulation pump 12. To hold the detergents the detergent feed facility has a reservoir 16 which has a plurality of chambers (not shown) and thus allows different detergents with different functions to be accommodated. These can typically be alkali agents, e.g. liquor, complexing and dispersing substances; e.g. polymers; enzymes such as amylase, protease or lipase; bleaching agents, e.g. hydrogen peroxide; bleach activator and surfactants, such as non-ionic surfactants for example. Liquids acting as biocides can also be stored, such as biocides against bacteria for example (bactericides), against spores (fungicides), against germs (microbicides), against viruses (virocides) and also against algae (algicides), which when added suppress unpleasant smells developing, e.g. caused by the formation of biofilms during longer idle periods. In this case the reservoir 16 is formed from the chambers for holding an amount of detergent which allows a plurality of washes to be undertaken.

During the operation of the domestic dishwasher 2 the circulated washing liquor collects in the floor area 10 of the domestic dishwasher 2 and is fed by a circulation pump 12 which is arranged in the floor pan of the domestic dishwasher 2 back to the spray arm 8. Door 24 is configured to hinge to allow for dirty dishes to be placed in crockery baskets 6, and to also allow for cleaned dishes to be removed following the washing process.

In the first exemplary embodiment in accordance with FIG. 1 the door 24 has a filling opening 20 on its inner door 26, meaning one side facing the washing area 4, which is connected via a line 22 with the reservoir 16 of the detergent feed facility 18.

On the other hand, in the second exemplary embodiment in accordance with FIG. 2, the refill fitting 20 is arranged at an upper edge 30 of the door 24, so that the refill fitting 20 is arranged so as not to be visible and accessible to an operator with the door 24 closed.

With both exemplary embodiments in accordance with FIGS. 1 and 2, the refill fitting 20 is embodied such that a refill element 32 having a plurality of chambers corresponding to the number of detergents to be supplied can be placed onto it. The reservoir 16 has a corresponding number of chambers and, to allow a simultaneous filling, the line 22 has a corresponding number of separate channels. They can be formed for example by hoses or by extruded profiles.

If the reservoir or one of the chambers of the reservoir is emptied, an appropriately embodied control of the domestic dishwasher 2 can be used to alert an operator to this fact, so that this operator refills the reservoir using a refill element 32.

To do this the door 20 is put into a half-opened position, in which for example the door 20 is opened at an angle of appr. 30 to 45 degrees and subsequently the refill element 32 is placed onto the refill fitting 20 arranged on the inner door 26 or the refill fitting arranged on the upper edge 30 of the door 24. In this position the outlet opening of the refill element 32 is essentially pointing downwards in the direction of gravity, so that automatic emptying of the refill element or of all chambers of the refill element 32 is guaranteed and the detergents pass through the line 22 to the chambers of the reservoir 16. When the refill element 32 is completely emptied, the refill element 32 can be taken off the connecting fitting 20 once more and the domestic dishwasher is ready to operate again. Subsequently it may be necessary to seal off the connecting flange 20 with a suitable closure element again or the closure element 20 has corresponding valve means which cause the flange to open automatically when a refill element 32 is placed on it and to close again automatically when the refill element 32 is removed.

LIST OF REFERENCE SYMBOLS

2 Domestic dishwasher
4 Wash area
6 Crockery basket
8 Spray arm
10 Floor area
12 Circulation pump
16 Reservoir
18 Detergent feed facility
20 Refill fitting
22 Line
24 Door
26 Inner door
28 Floor pan
30 Upper edge
32 Refill element

The invention claimed is:

1. A water-conducting domestic appliance comprising:

a washing chamber;

a door to open or close the washing chamber;

a floor pan underneath the washing chamber;

a line system;

a detergent feed facility that supplies at least one detergent into the line system, wherein the detergent feed facility includes at least one reservoir configured to be filled with detergent, and wherein the detergent feed facility is arranged in the floor pan underneath the washing chamber; and a refill fitting having a connection to the at least one reservoir, the refill fitting being arranged on the door of the water-conducting domestic appliance.

2. The water-conducting domestic appliance as claimed in claim 1, wherein the refill fitting is arranged so as to be only accessible to an operator when the door is opened.

3. The water-conducting domestic appliance as claimed in claim 2, wherein the refill fitting is arranged on an inner side of the door.

4. The water-conducting domestic appliance as claimed in claim 2, wherein the refill fitting is arranged on an upper edge of the door.

5. The water-conducting domestic appliance as claimed in claim 2, wherein the water-conducting domestic appliance is a domestic dishwasher.

6. The water-conducting domestic appliance as claimed in claim 1, comprising:

a circulation pump having a connection to the detergent feed facility.

7. The water-conducting domestic appliance as claimed in claim 6, comprising:

load detection means for detection of load fluctuations of the circulation pump.

8. The water-conducting domestic appliance as claimed in claim 1, comprising:

a conductivity sensor for detecting a conductivity of washing liquor in the water-conducting domestic appliance.

9. The water-conducting domestic appliance as claimed in claim 1, wherein the detergent feed facility includes pumping means for introducing at least one detergent.

10. The water-conducting domestic appliance as claimed in claim 1, wherein the detergent feed facility has at least one dosing chamber.

11. The water-conducting domestic appliance as claimed in claim 1, wherein the detergent feed facility is configured to empty automatically by force of gravity.

12. The water-conducting domestic appliance as claimed in claim 1, comprising:

a refill element for filling the detergent feed facility.

13. The water-conducting domestic appliance as claimed in claim 12, wherein the refill fitting corresponds to a connection of the refill element.

14. A water-conducting domestic appliance comprising:

a wash area including a crockery basket for retaining crockery to be washed;

a door for accessing the wash area;

a line system for supplying washing liquor to the crockery to be washed; and a detergent feed facility in a floor pan of the wash area that supplies at least one detergent into the line system, wherein the detergent feed facility includes at least one reservoir configured to be filled with detergent, and wherein the door includes a refill fitting that is coupled to the at least one reservoir.

15. The water-conducting domestic appliance as claimed in claim 14, wherein the water-conducting domestic appliance is a domestic dishwasher.

16. The water-conducting domestic appliance as claimed in claim 14, wherein the refill fitting only is accessible to an operator when the door is in an open position.

17. The water-conducting domestic appliance as claimed in claim 14, wherein the refill fitting is on an inner side of the door facing the wash area.

18. The water-conducting domestic appliance as claimed in claim 14, wherein the refill fitting is on an upper edge of the door.

19. The water-conducting domestic appliance as claimed in claim 14, comprising:

a refill element coupled to the refill fitting for filling the detergent feed facility.

20. The water-conducting domestic appliance as claimed in claim 14, wherein the door includes at least one line connecting the refill fitting to the at least one reservoir.

21. The water-conducting domestic appliance as claimed in claim 20, wherein the at least one reservoir includes a plurality of chambers, wherein the at least one line includes a plurality of separate channels connecting the refill fitting to the plurality of chambers.

22. The water-conducting domestic appliance as claimed in claim 21, wherein one of the plurality of separate channels includes one of a hose and an extruded profile.

23. A water-conducting domestic appliance, comprising:

a door to a wash chamber;

a refill fitting disposed on a surface of the door;

a line system;

a detergent feed facility with at least one reservoir in a floor pan of the wash chamber;

at least one dosing chamber; and a circulation pump downstream of the at least one dosing chamber;

wherein the refill fitting, the line system, and the at least one reservoir are configured to deliver at least one detergent from the refill fitting, through the line system, and to the at least one reservoir via gravity; and further wherein the at least one reservoir is configured to deliver the at least one detergent to the at least one dosing chamber for mixture with rinsing water to create washing liquor that is delivered by the circulation pump to the wash chamber.

* * * * *

UNITED STATES PATENT AND TRADEMARK OFFICE

CERTIFICATE OF CORRECTION

PATENT NO. : 8,381,745 B2
APPLICATION NO. : 12/515867
DATED : February 26, 2013
INVENTOR(S) : Classen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 647 days.

Signed and Sealed this
First Day of September, 2015

Michelle K. Lee

Michelle K. Lee
*Director of the United States Patent and Trademark Office*